United States Patent [19]

Vittands et al.

[11] 4,168,983

[45] Sep. 25, 1979

[54] PHOSPHATE COATING COMPOSITION

[76] Inventors: Walter A. Vittands, 17 Burrows St., Boston, Mass. 02130; William M. McGowan, 94 Flint St., Lynn, Mass. 01905

[21] Appl. No.: 896,138

[22] Filed: Apr. 13, 1978

[51] Int. Cl.[2] ..... C09D 5/12; C23F 7/10

[52] U.S. Cl. ..... 106/14.12; 148/6.15 Z; 252/387; 422/12

[58] Field of Search ..... 106/14.12; 148/6.15 Z; 423/314; 252/387; 21/2.7 A; 422/12

[56] References Cited

U.S. PATENT DOCUMENTS

| | | | |
|---|---|---|---|
| 2,332,209 | 10/1943 | Enquist | 148/6.15 Z |
| 2,743,204 | 4/1956 | Russell | 148/6.15 Z |
| 3,181,976 | 5/1965 | Yager | 148/6.15 Z |
| 4,022,887 | 5/1977 | Harris et al. | 424/128 |

*Primary Examiner*—Lorenzo B. Hayes

[57] ABSTRACT

This invention relates to phosphating ferrous metal surfaces and more particularly, to new phosphating compositions characterized by the use of a cyclic trimetaphosphate as one of the phosphates comprising the phosphating composition. The cyclic trimetaphosphate permits lower operating temperature, increases the concentration tolerance of the phosphating solution to dissolved iron and provides an improved phosphate coating that is thinner, smoother and more corrosion resistant.

10 Claims, No Drawings

PHOSPHATE COATING COMPOSITION

BACKGROUND OF THE INVENTION

1. Introduction

This invention is directed to improved phosphating compositions for ferrous based metals.

2. Description of the Prior Art

As is well known in the art, phosphate coatings are conversion coatings for iron based metals. The coatings serve as a base for organic coatings to aid in cold forming, to improve wear resistance or to impart color and to provide corrosion resistance to the base metal. The coatings are for the most part phosphates of metals in the phosphating solution (the primary metal) and of iron from the base metal. Formation of a phosphate coating is by contact of the base metal with a phosphating composition for a time and at a temperature necessary to provide a coating of the desired thickness. Methods and compositions for phosphating are well known and disclosed in numerous publications including, for example, *The 44th Annual Edition of Metal Finishing Guidebook and Directory,* Metal and Plastics Publications, Inc., Hackensack, N.J., 1976, pp 554–566; Burns and Bradley, *Protective Coatings for Metals,* Reinhold, 1967, 3rd Edition, pp 568–575; and U.S. Pat. Nos. 2,164,042; 2,326,309; and 2,351,605, all incorporated herein by reference.

Compositions for phosphating a surface typically comprise a dilute aqueous acidic solution of a metal phosphate formed by the dissolution of a primary metal salt in phosphoric acid, free salt, phosphoric acid and an oxidizing agent as an accelerator. The metal salt dissolved in the phosphoric acid is most often zinc oxide with the formation of a primary zinc phosphate but salts of manganese and iron are often used either alone or in combination with the zinc oxide. A phosphate coating is formed by free phosphoric acid attacking the metal surface liberating iron which goes into solution thus providing iron phosphate in solution in addition to the primary metal phosphates. At the interface of a base metal surface and the solution, the pH is altered resulting in the insolubilization of the phosphates and precipitation of the same on the surface of the base metal forming the conversion coating. An overall reaction for formation of the coating can be written as follows using zinc as illustrative of the primary metal in the solution:

$$3Zn(H_2PO_4)_2+Fe+4H_2O \rightarrow Zn_3(PO_4)_2 4H_2O + FeHPO_4+3H_3PO_4+H_2$$

The combination of the zinc and iron phosphates in the above equation represents the phosphate coating.

Though phosphate coatings have been used for many years, one limitation in the use of the conventional phosphating solutions is a sensitivity to contamination by excessive iron phosphates in solution. A fresh phosphating solution is typically free of iron phosphates. Thus, a coating produced therefrom would contain a minimum amount of iron phosphate derived from solubilization of iron by phosphoric acid. As the phosphating solution is used to phosphate additional surface area, the concentration of the dissolved iron in solution increases resulting in a concomitant increase of iron phosphate in the phosphate coating. Some iron phosphate in the coating is beneficial but excessive amounts detract from the quality of the coating. Therefore, when the concentration of iron in solution becomes excessive—i.e., in excess of 0.5% by weight, the coating quality is adversely affected and ultimately, the phosphating solution will no longer be operative.

An additional limitation with most known phosphating solutions is the requirement that they be operated at a relatively high operating temperature, typically in the range of 200° F. This causes difficulty in control of the bath and results in excess energy consumption.

As to phosphate coatings obtained from known phosphating compositions, they improve the corrosion resistance of the surface. For example, typically, using phosphating compositions containing zinc as the primary metal, such coatings are able to withstand about 2 to 8 hours of salt spray in weights of about 2000 to 3000 milligrams per square foot. Decreased salt spray resistance is encountered when manganese is the primary metal. However, greater corrosion resistance is desirable for many purposes.

BRIEF SUMMARY OF THE INVENTION

It is an object of the present invention to provide a composition for producing phosphate coatings on ferrous metal surfaces which composition is capable of tolerating increased concentrations of dissolved iron, typically twice as much as in the prior art, without adverse effects on the phosphate coating or the solution performance.

Another object of this invention is to provide a phosphate coating composition which will produce a dense and smooth phosphate coating at operative temperatures as low as 140°–170° F.

A further object of the present invention is to provide phosphate coatings over ferrous metal with improved corrosion resistance, preferably able to withstand in excess of 12 hours of salt spray following the procedures of ASTM B-117.

DESCRIPTION OF THE PREFERRED EMBODIMENTS

With the exception of the addition of a cyclic trimetaphosphate to the phosphating composition, the compositions of this invention are those conventionally used in the art. The primary metal of the phosphating composition is preferably zinc but maganese may be used alone or in admixture with zinc or combinations of metals may be used such as zinc-calcium and zinc-calcium-manganese. The concentrations of the primary metal may vary within a broad range as is known in the art dependent upon how heavy a phosphate coating is desired. Typically, the concentration varies from about 0.1 to 3 moles per liter, the higher concentrations providing heavier coatings—i.e., 1000 or more milligrams of coating per square foot.

Phosphoric acid is used as a source of acidity and as a source of phosphate to form phosphates of the primary metal and dissolved iron. Its concentration can also vary within wide limits, again dependent upon the weight of the desired coating. Typically, its concentration ranges from about 1 to 8 moles per liter. As a guideline only, it is conveniently used in an amount slightly in excess of that necessary to maintain the phosphate dissolved in solution.

In order to increase the rate of the phosphating reaction and to inhibit the buildup of ferrous ions in solution, it is customary to include an oxidizing agent in the phosphating solution referred to in the art as an accelerator. Typical accelerators include salts of nitrites, chlorates and peroxides and oxidizing acids such as nitric and perchloric acids. Other materials have been proposed as accelerators including (1) reducing agents such as sulfites and hydroylamines, (2) organic compounds such as quinoline, toluidine, and nitrophenols, and (3) heavy metals such as copper, nickel and chromium. Only the oxidizing agents as accelerators have achieved major industrial importance.

As is known in the art, other additives are included in phosphating solutions such as pH adjustors, levelers and the like. Such materials are conventional and are not considered to be part of the inventive concept set forth herein.

The phosphating solutions of this invention are characterized by the addition of a cyclic trimetaphosphate conforming to the formula:

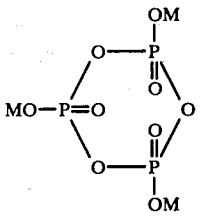

where M is a metal, preferably an alkali or alkaline earth metal though other metallic cations may be used provided they do not adversely affect the properties of the phosphate coating. The concentration of the trimetaphosphate is preferably maintained low, 0.001 moles per liter providing some benefit and increasing amounts providing increased benefits up to a maximum of about 0.15 moles per liter. A preferred range varies between 0.01 and 0.1 moles per liter. As the concentration increases above 0.15 moles per liter, the corrosion resistance drops off but then increases again as the concentration reaches about 0.25 moles per liter. Consequently, higher concentrations may be used but are less preferred because of cost and further, at the higher concentrations, results are not easily reproducible and the good results are obtainable only with relatively fresh solutions. Accordingly, the concentration range for the cyclic trimetaphosphate is that concentration yielding a solution meeting the objects of this invention, but preferably, the lower range is used rather than the higher ranges.

Any ferous based metal to which a phosphate coating has been applied in the prior art may be treated with the phosphating compositions of this invention. The part is first prepared in accordance with prior art procedures and then immersed in the phosphating composition maintained at a temperature preferably between 160° and 180° F. for a time sufficient to yield a coating of desired thickness. Both higher and lower temperatures than set forth in the preferred range may be used, but the coatings produced outside the preferred range may not be of the same quality.

The following example represents a preferred phosphating composition in accordance with the invention together with an illustrative procedure for forming said coating.

EXAMPLE 1

A concentrated aqueous composition of the following composition is prepared:

Phosphoric Acid (75%)—380 g
Nitric Acid (67%)—142 g
Zinc Oxide—160 g
Sodium trimetaphosphate—3.3 g
Water—to 1 liter To make an operating bath, 7.5 parts of the above concentrate are diluted with 92.5 parts of water and to simulate a used commercial formulation, 0.7% by weight iron in the form of steel wool is added.

A 26 Ga. No. 87 steel test panel was prepared for phosphating by a sequence of steps comprising:

(a) Immerse in hot alkaline cleaner for 10 minutes at about 180° F. (cleaner S-9 of Lea Manufacturing).

(b) Hot water rinse (about 170° F.).

(c) Pickle in 10% by weight hydrochloric acid by immersion for 10 minutes at room temperature.

(d) Cold water rinse.

(e) Immerse in conditioner of oxalic acid for 1 minute at room temperature.

(f) Cold water rinse.

Following preparation of the panel, it was immersed in the above composition maintained at a temperature of 170° F. for 20 minutes, removed and rinsed. The phosphate coating so formed has a weight of about 2250 milligrams/sq.ft.

The coated part was tested for corrosion resistance by a salt spray following ASTM B-117 procedures. The test was discontinued after 24 hours without failure establishing that salt spray resistance exceeded 24 hours. Failure is defined for purposes herein as rust both on the sharp edges of the part and readily visible over the smooth surfaces. It should be understood that the test involves some subjectivity and there exists the possibility for experimental error.

The above procedure was repeated, but the phosphating formulation used was free of the trimetaphosphate. The coating weight was about 3200 milligrams per sq.ft. The salt spray test was repeated and the part failed between 4 and 6 hours of exposure.

EXAMPLES 2-10

The procedure of Example 1 was repeated but the concentration of the cyclic sodium trimetaphosphate (TMP) was varied with results as follow:

| Ex. No. | TMP Concentration | 24 Hr. salt spray |
|---|---|---|
| 2 | 0 | failed |
| 3 | 0.5 | failed |
| 4 | 1.0 | failed |
| 5 | 2.0 | failed |
| 6 | 3.3 | passed |
| 7 | 25 | passed |
| 8 | 50 | failed |
| 9 | 75 | failed |
| 10 | 100 | passed |

EXAMPLES 11 and 12

A concentrated aqueous solution of the following composition was prepared:

Phosphoric Acid (75%)—530.5 g
Manganese Carbonate (45% Mn)—189.0 g
Ammonium nitrate—34.0 g
Sodium trimetaphosphate—5.0 g
Water—to 1 liter Ten parts of the above concentrate were diluted with 90 parts of water to make an operating bath.

In this example, 0.59% iron was added as steel wool. The 26 GA. No. 87 test panel was sand blasted to prepare the same. The part was immersed in the above formulation for 20 minutes at 165° F. The coating weight was 2057 and salt spray resistance again exceeded 24 hours.

The procedure was repeated without the trimetaphosphate but a coating able to withstand even 1 hour of salt spray was unobtainable. Therefore, the iron content was reduced to 0.31 percent and the temperature increased to 200° F. Coating weight was 2547 milligrams per sq.ft. and salt spray resistance before failure was from 2 to 4 hours.

We claim:

1. In a phosphating composition for formation of a phosphate coating on ferrous based metal comprising an aqueous acidic solution of a primary phosphate, the improvement comprising a cyclic trimetaphosphate in solution in a concentration sufficient to improve salt spray resistance.

2. The composition of claim 1 including free phosphoric acid.

3. The composition of claim 2 where the primary phosphate is selected from the group of phosphates of zinc, manganese, iron and mixtures thereof.

4. The composition of claim 3 where the primary phosphate is of zinc.

5. The composition of claim 2 where the concentration of the cyclic trimetaphosphate is sufficient to provide a coating having a salt spray resistance of at least 12 hours prior to failure using the procedure of ASTM B-117.

6. The composition of claim 2 where the cyclic trimetaphosphate is an alkali or alkaline earth metal salt thereof present in an amount of at least 0.001 moles per liter.

7. The composition of claim 2 where the concentration varies between 0.01 and 0.15 moles per liter.

8. In a zinc phosphating composition for formation of a phosphate coating on ferrous based metal comprising an aqueous acidic solution containing a source of zinc and free phosphoric acid, the improvement comprising a cyclic trimetaphosphate in an amount of at least 0.001 moles per liter.

9. The composition of claim 8 where the cyclic trimetaphosphate is an alkali or alkaline earth metal salt.

10. The composition of claim 8 where the concentration of the cyclic trimetaphosphate varies between about 0.1 and 0.15 moles per liter.

* * * * *